US005195616A

United States Patent [19]

Yoo et al.

[11] Patent Number: 5,195,616

[45] Date of Patent: Mar. 23, 1993

[54] ONE TO TWO STROKE ROPED ELEVATOR PIT BUFFERS

[75] Inventors: Young S. Yoo, Avon; John K. Salmon, South Windsor, both of Conn.

[73] Assignee: Otis Elevator Company, Farmington, Conn.

[21] Appl. No.: 914,821

[22] Filed: Jul. 15, 1992

[51] Int. Cl.[5] ..... B66B 5/28

[52] U.S. Cl. ..... 187/67; 187/75

[58] Field of Search ..... 187/67, 68, 69, 70, 187/75

[56] References Cited

U.S. PATENT DOCUMENTS 751,504 2/1904 Hallock ..... 187/67

1,424,665 8/1922 Moschos ..... 187/67

1,581,458 4/1926 Lindquist ..... 187/67 X 3,768,596 10/1973 Solymos ..... 187/67 X

*Primary Examiner*—Robert P. Olszewski

*Assistant Examiner*—Dean A. Reichard

*Attorney, Agent, or Firm*—William W. Jones

[57] ABSTRACT

An elevator pit buffer assembly includes a pair of pistons which are mounted in the pit outboard of each side of the cab and counterweight. Each of the buffer pistons is equipped with a sheave joined at the upper end thereof. Ropes are reeved about each buffer sheave pair and extend between the sheaves in each pair beneath the bottom of the cab and counterweight. The ends of each of the buffer ropes are dead-hitched to the floor or wall of the pit.

6 Claims, 2 Drawing Sheets

ONE TO TWO STROKE ROPED ELEVATOR PIT BUFFERS

DESCRIPTION

1. Technical Field

This invention relates to elevator cab and counterweight buffer assemblies, and more particularly to buffer assemblies for use in high speed elevator systems.

2. Background Art

Oil buffers used in elevator systems for the cab and counterweight must be able to retard downward movement to the cab or counterweight at an average retardation rate of up to 32 feet/sec.2 when brought to rest after striking the buffer at 115% of the rated speed of the cab/counter-weight. It will be appreciated that with higher speed elevator systems, the buffers will require a longer piston stroke to properly bring the cab/counterweight to rest with the minimum acceptable piston stroke being proportional to the rated speed of the system. For example, a 2,000 feet/minute cab speed requires a 274-inch stroke, and a 2,500 feet/minute cab speed requires a 428-inch stroke. The ANSI code allows the use of reduced buffer strokes when an emergency terminal speed limiting device is included in the system; however, the code requires that the reduced buffer stroke can be no less than one-third of the minimum stroke required at the full speed when no speed limiting devices are used. This means that the 2,000 feet/minute system requires at least a 92-inch buffer stroke, and the 2,500 feet/minute requires at least a 143-inch buffer stroke. The minimum permissible buffer strokes at these higher speeds are thus of such a magnitude as to require a significant increase to pit depth and overhead room, which add to the cost of buildings. When existing installations are modernized, the existing pit depth thus becomes a limiting factor which will foreclose the upgrade to higher speed systems.

DISCLOSURE OF THE INVENTION

This invention relates to an improved elevator pit buffer assembly for use with high speed elevator systems. The buffer assembly of this invention produces a motion retarding stroke which is greater than the buffer piston stroke, whereby shorter buffer pistons can be used to produce longer motion retarding strokes.

This invention involves the use of an elevator cab buffer assembly and a separate elevator counterweight buffer assembly. Both the cab and counterweight buffer assemblies are substantially identical in construction and utilize the same operational principles. Since both of the buffer assemblies are the same in principle, they utilize common components and can be assembled side-by-side in the elevator pit. Each of the buffer assemblies includes a pair of hydraulic cylinder/piston components which are mounted on the pit floor outboard of the sides of the cab or counterweight. Thus, the cab or counterweight could descend to the pit floor and fit between the cylinder/piston components in each pair thereof. The pistons are provided with a sheave joined in the upper end thereof, and the sheaves are sized so as to remain outboard of the cab and counterweight. Cables are reeved over the piston sheaves on the cab and counterweight buffer pairs and extend underneath the cab and counterweight respectively. The ends of the cables are dead hitched to the floor cylinder, or walls of the pit outboard of the pistons and below the piston sheaves. The cab and counterweight assembly may be provided with downwardly projecting catcher bars which are aligned with and will contact the buffer cables in the event of a descent of either the cab or the counterweight into the hoistway pit.

It is therefore an object of this invention to provide an elevator pit buffer system which supplies a safety stroke that is greater than the stroke of the buffer piston.

It is a further object of this invention to provide a buffer system of the character described which can be used with high speed elevator systems without requiring excessively long buffer pistons.

It is an additional object of this invention to provide a buffer system of the character described wherein the cab and counterweight are provided with buffer pistons disposed outboard of the sides of the cab and counterweight, and dead-ended cables are reeved over sheaves joined on the upper ends of the pistons, which cables extend beneath the cab and counterweight respectively.

BRIEF DESCRIPTION OF THE DRAWING

These and other objects and advantages of the invention will become readily apparent from the following description of a preferred embodiment of the invention when taken with conjunction with the accompanying drawings in which.

DISCLOSURE OF THE BEST MODE EMBODIMENT

Figure 1:
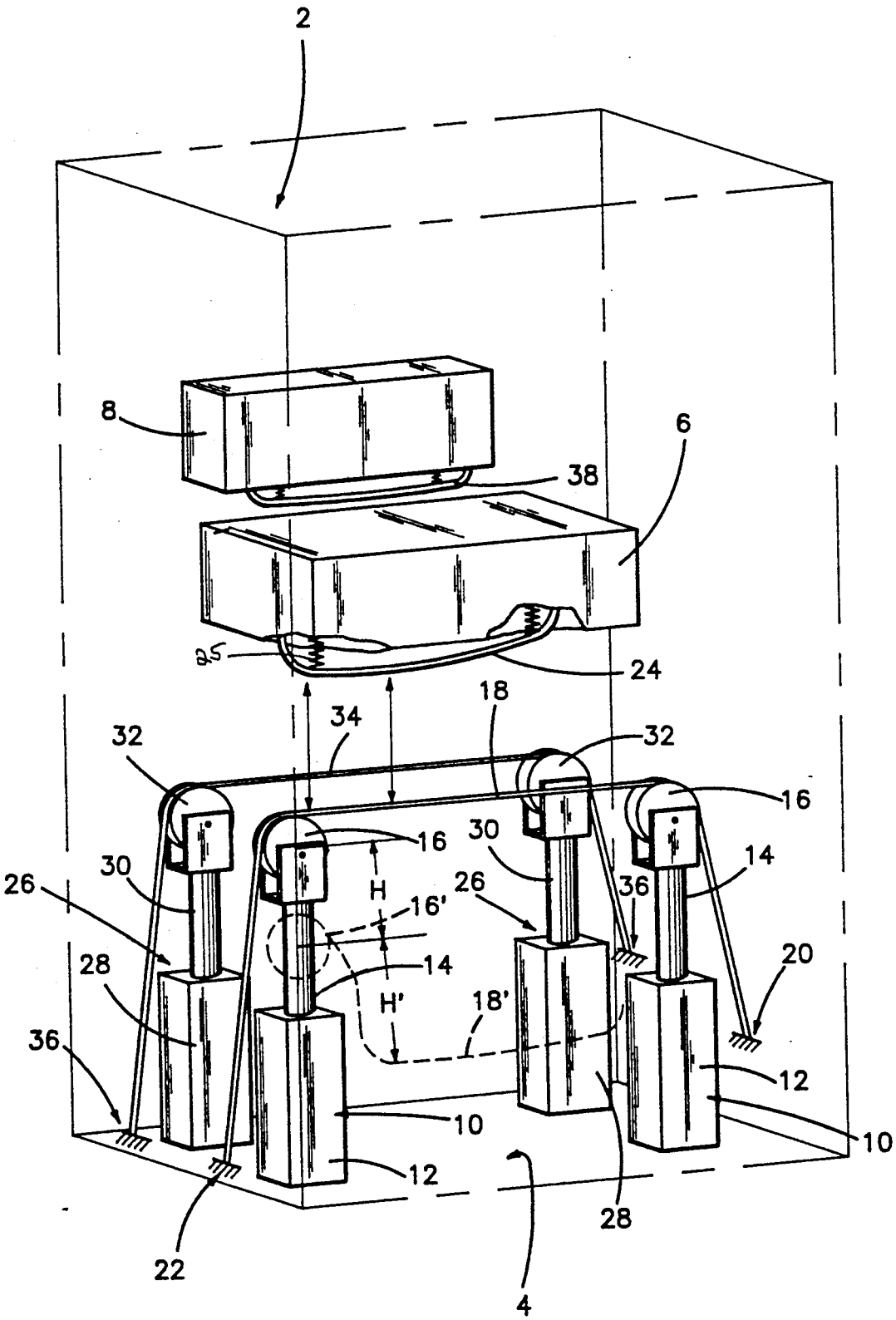
FIG. 1 a schematic representation of the hoistway pit area of an elevator system.
Figure 2:
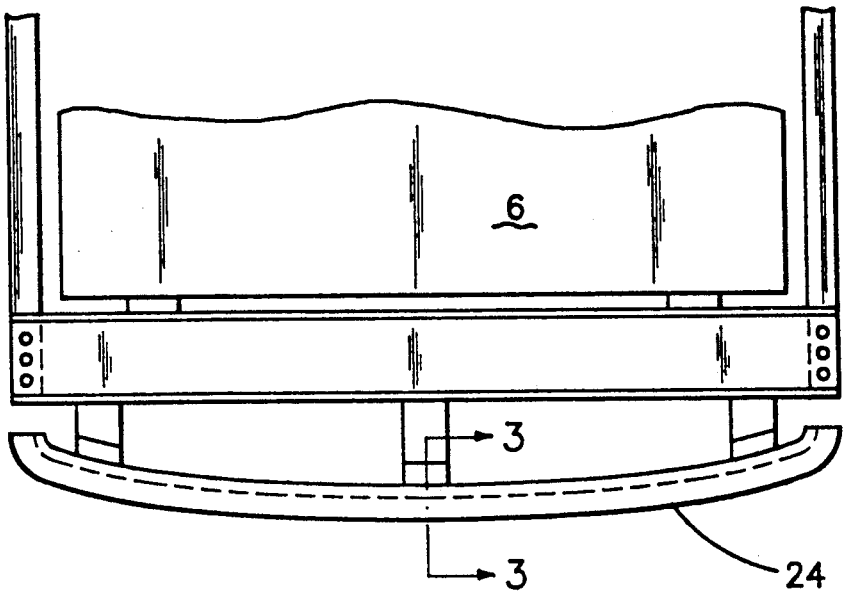
FIG. 2 is a fragmented elevational view of the rope catcher.
Figure 3:
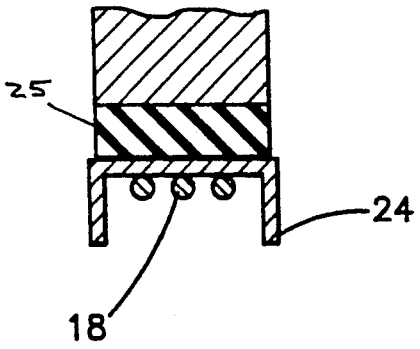
FIG. 3 is a fragmented sectional view of the rope catcher along lines 3—3 of FIG. 2.

Referring to the drawing, there is shown in highly schematic fashion the pit area of an elevator hoistway. The hoistway is denoted generally by the numeral 2 and the pit floor is denoted by the numeral 4. The cab 6 moves up and down in the hoistway 2 over guide rails (not shown) and the counterweight 8 which is connected to the cab 6 by traction cables (not shown) also moves up and down in the hoistway 2 on a second set of guide rails (not shown). Hydraulic buffer assemblies 10 for the cab 6 are mounted on the pit floor 4 outboard of the sides of the cab 6. Each assembly 10 includes an hydraulic cylinder 12 and a reciprocating piston 14. Cab buffer sheaves 16 are joined on the pistons 14 at the upper ends thereof. A cab buffer cable 18 is reeved over the sheaves 16 and has its opposite ends dead-hitched to the hoistway wall as at 20 or to the pit floor as at 22, both of which dead-hitch securements will be disposed below the cab buffer sheaves 16. The bottom of the cab 6 may be equipped with a cable catcher 24 in the form of an inverted channel as shown in FIGS. 2 and 3, which will engage the cable 18 should the cab 6 strike the cab buffer assembly. Cable 18 can be multiple ropes and all ropes will be inside the catcher 24 as shown in FIG. 3. The catcher 24 should preferably be radiused so as to minimize cable distortion and bending. The catcher member 24 is also mounted flexibly with springs 25 to take up the initial impact load.

The counterweight 8 is provided with a buffer which comprises hydraulic buffer assemblies 26 which are disposed outboard of the path of travel of the counterweight 8. Each buffer assembly 26 includes an hydraulic cylinder 26 and a piston sheave 32 joined on the upper end of each piston 30. A buffer cable 34 is reeved over each of the piston sheaves 32 and extends beneath the counterweight 8, with each of its ends being dead-hitched to the hoistway wall or pit floor as at 36. The counterweight 8 is also provided with a cable catcher 38 which is similar in configuration to the cab cable catcher 24.

Operation of the buffer assemblies is demonstrated by the phantom lines in the drawing which relate to the cab buffer assembly. Presume that the cab 6 has descended into the pit sufficiently to cause the catcher 24 to contact the buffer cable 18 and retract the pistons 14 into the cylinders 12 to the extent needed to displace the cab buffer sheaves 16 to the positions 16' indicated in phantom, such displacement being indicated by the letter H in the drawing. When this happens, the cab buffer cable 18 will drop to the position 18' shown in phantom, which position 18' is an additional distance H' below the top of the displaced piston sheaves 16'. The roping of the piston sheaves 16 causes the distances H and H' to be equal. Thus when the piston sheaves 16 are deflected downwardly a distance H, the cable 18 will drop twice that distance. Since the position of the cable 18 determines the position of the cab 6, the cushioning action of the cab buffer assembly (and also the counterweight buffer assembly) will be twice the stroke length of the pistons 14 up to a preset maximum piston stroke.

Reverting back to minimum ANSI buffer strokes, it will be readily appreciated that the 92-inch minimum buffer stroke required for the 2000 feet/minute high speed elevator can be accomplished by a 46-inch piston stroke using the assembly of this invention, and the 143-inch buffer stroke needed for the 2,500 feet/minute elevator requires only a 71.5-inch piston stroke. This invention thus allows the designer to use buffer pistons of reasonably short lengths for the high and ultra high speed elevators desired in high-rise buildings. It will be appreciated that the buffer assembly of this invention can be easily installed in new construction or retrofitted into older buildings if necessary. The components are all relatively conventional components and none are outsized to accommodate the higher speeds of the cab and counterweight.

Since many changes and variations of the disclosed embodiment of the invention may be made without departing from the invention concept, it is not intended to limit the invention otherwise than as required by the appended claims.

What is claimed is:

1. A pit buffer assembly for use in an elevator system comprising a cab and counterweight interconnected by traction cables, said buffer assembly being operable to intercept the cab or counterweight in the hoistway pit, said buffer assembly comprising:

a) a pair of cooperating fluid operated piston and cylinder buffer assemblies, one of said piston and cylinder buffer assemblies being positioned on one side of the path of travel of said cab or counterweight, and the other of said piston and cylinder buffer assemblies being positioned on an opposite side of the path of travel of said cab or counterweight, said piston and cylinder buffer assemblies being positioned so as to avoid direct contact with said cab or counterweight, b) cable means extending between said piston and cylinder buffer assemblies, said cable means having opposite ends thereof dead hitched to a fixed portion of the pit, and being reeved across an upper part of each of said piston and cylinder buffer assemblies whereby the medial portion of said cable means is disposed in a substantially horizontal plane containing said upper part of each of said piston and cylinder buffer assemblies when said cab or counterweight is upwardly offset from said cable means; and c) said cable means being operable, when contacted by a descending cab or counterweight, to drop below said upper parts of said piston and cylinder buffer assemblies to provide a buffer stroke for decelerating said descending cab or counterweight which buffer stroke is greater than a corresponding downward stroke of said piston and cylinder buffer assemblies.

2. The pit buffer assembly of claim 1, further comprising a sheave journaled on said upper part of each of said piston and cylinder buffer assemblies, and said cable means being reeved over each of said sheaves.

3. The pit buffer assembly of claim 2, further comprising cable catcher means mounted on a lowermost part of said cab or counterweight for engagement with said cable means.

4. The pit buffer assembly of claim 3, wherein said cable catcher means has a curved profile operable to minimize cable bend when engaging said cable means.

5. The pit buffer assembly of claim 4, further comprising spring means mounting said cable catcher means to said cab or counterweight.

6. The pit buffer assembly of claim 2, in which said cable means comprises a plurality of adjacent cables.

* * * * *